US006220350B1

(12) United States Patent
Brothers et al.

(10) Patent No.: US 6,220,350 B1
(45) Date of Patent: Apr. 24, 2001

(54) HIGH STRENGTH WATER SOLUBLE PLUG

(75) Inventors: Lance E. Brothers, Chickasha; Larry S. Eoff, Duncan, both of OK (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/204,619

(22) Filed: Dec. 1, 1998

(51) Int. Cl.[7] ..... E21B 33/13
(52) U.S. Cl. ..... 166/192; 166/294; 166/376
(58) Field of Search ..... 166/294, 295, 166/192, 317, 376, 386, 292

(56) References Cited

U.S. PATENT DOCUMENTS

| | | | | |
|---|---|---|---|---|
| 3,306,870 | * | 2/1967 | Eilers et al. | 524/413 |
| 3,362,476 | | 1/1968 | Van Poollen . | |
| 3,447,608 | * | 6/1969 | Fry et al. | 166/293 |
| 3,861,467 | | 1/1975 | Harusberger . | |
| 4,154,303 | | 5/1979 | Fournier . | |
| 4,160,484 | | 7/1979 | Watkins . | |
| 4,183,406 | * | 1/1980 | Lundberg et al. | 166/295 |
| 4,186,803 | | 2/1980 | Mandshiue . | |
| 4,216,830 | | 8/1980 | Fredd . | |
| 4,374,543 | | 2/1983 | Richardson . | |
| 4,378,049 | | 3/1983 | Hsu et al. . | |
| 4,423,773 | | 1/1984 | Stout . | |
| 4,428,427 | | 1/1984 | Friedman . | |
| 4,433,702 | | 2/1984 | Baker . | |
| 4,500,357 | * | 2/1985 | Brothers et al. | 106/90 |
| 4,541,484 | | 9/1985 | Salerni et al. . | |
| 4,597,445 | | 7/1986 | Knox . | |
| 4,603,741 | * | 8/1986 | Edgmon | 166/369 |
| 4,691,775 | | 9/1987 | Lustig et al. . | |
| 4,721,159 | | 1/1988 | Ohkochi et al. . | |
| 4,813,481 | | 3/1989 | Sproul et al. . | |
| 4,817,720 | | 4/1989 | Friedman et al. . | |
| 4,888,240 | | 12/1989 | Graham et al. . | |
| 4,898,750 | | 2/1990 | Friedman et al. . | |
| 5,181,569 | | 1/1993 | McCoy et al. . | |
| 5,188,182 | | 2/1993 | Echols, III et al. . | |
| 5,188,183 | | 2/1993 | Hapmann et al. . | |
| 5,253,706 | | 10/1993 | Reid . | |
| 5,404,556 | | 4/1995 | Bohlen et al. . | |
| 5,417,285 | | 5/1995 | Van Buskirk et al. . | |
| 5,441,111 | | 8/1995 | Whiteford . | |
| 5,479,986 | | 1/1996 | Gano et al. . | |
| 5,484,020 | * | 1/1996 | Cowan | 166/295 |
| 5,607,017 | | 3/1997 | Owens et al. . | |
| 5,685,372 | * | 11/1997 | Gano | 166/292 |
| 5,709,269 | * | 1/1998 | Head | 166/376 |
| 5,947,204 | * | 9/1999 | Barton | 166/317 |

FOREIGN PATENT DOCUMENTS

0401936 * 12/1990 (EP) .

OTHER PUBLICATIONS

Omega 2.1 Unibalance Pressure Cycle Plug; Dated 1995.

* cited by examiner

*Primary Examiner*—David Bagnell
*Assistant Examiner*—Zakiya Walker
(74) *Attorney, Agent, or Firm*—Paul I. Herman; Marlin R. Smith

(57) ABSTRACT

Apparatus for use in operations performed in conjunction with a subterranean well is provided by the present invention. In one described embodiment, a plug apparatus includes a soluble polymer material, which is utilized in a plug member for blocking flow through a fluid passage. In another described embodiment, a soluble polymer material is utilized in a blocking member for blocking displacement of a displacement member of an apparatus.

47 Claims, 3 Drawing Sheets

HIGH STRENGTH WATER SOLUBLE PLUG

BACKGROUND OF THE INVENTION

The present invention relates generally to operations performed in conjunction with a subterranean well and, in an embodiment described herein, more particularly provides apparatus including a high strength water soluble plug.

For economy of manufacture, convenience of assembly and use, etc., it would be quite desirable to fabricate certain components of apparatus used in operations performed in conjunction with subterranean wells of soluble polymeric material. In this manner, operation of the apparatus could be controlled, at least in part, by controlling contact between the polymer and the fluid in which it is soluble.

For example, it would be desirable to construct a plug apparatus in which a plug member blocking flow through a fluid passage included a soluble polymer. Subsequent contact between the polymer and the fluid in which it is soluble would enable the plug member to be dispersed, thereby permitting flow through the fluid passage.

As another example, it would be desirable to construct an apparatus in which a displacement member displaces in operation of the apparatus, and in which a blocking member blocks displacement of the displacement member. Subsequent contact between the polymer and the fluid in which it is soluble would permit displacement of the displacement member, thereby controlling operation of the apparatus.

Therefore, it would be advantageous to provide apparatus in which a soluble polymer is utilized to control, at least in part, operation of the apparatus. It is accordingly an object of the present invention to provide such apparatus.

SUMMARY OF THE INVENTION

In carrying out the principles of the present invention, in accordance with embodiments thereof, apparatus is provided which is used in conjunction with operations performed in a subterranean well. In one embodiment, a plug member of a plug apparatus includes a soluble polymer. In another embodiment, an apparatus blocking member, which includes a soluble polymer, blocks displacement of a displacement member.

In one aspect of the present invention, a plug apparatus includes a plug member blocking flow through a fluid passage. The plug member is constructed of a polymer soluble in a fluid. The fluid is placed in contact with the soluble polymer, thereby permitting the plug member to be dispersed and permitting flow through the fluid passage. The plug member may also include other soluble material, such as salt, and crack initiator material, such as sand.

In another aspect of the present invention, an apparatus includes a displacement member and a blocking member preventing displacement of the displacement member. In an embodiment of the apparatus disclosed herein, the apparatus is a valve in which displacement of a closure member is blocked by a member constructed of a polymer soluble in a fluid. The fluid is placed in contact with the soluble polymer, thereby permitting the closure member to displace and operate the valve.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
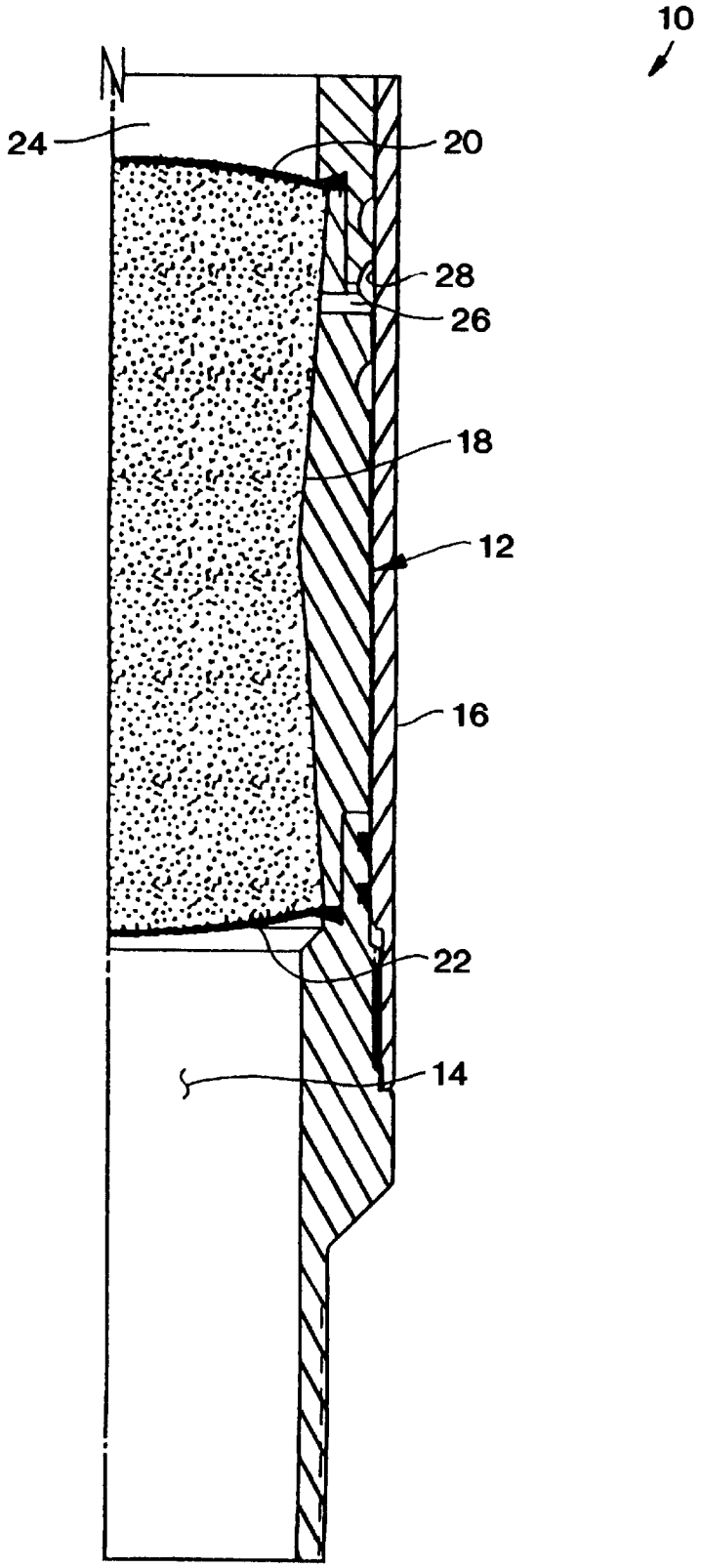
FIG. 1 is a quarter-sectional view of a first apparatus embodying principles of the present invention.

Representatively illustrated in FIG. 1 is a plug apparatus 10 which embodies principles of the present invention. In the following description of the plug apparatus 10 and other apparatus and methods described herein, directional terms, such as "above", "below" "upper", "lower" etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The plug apparatus 10 is similar in many respects to the plug apparatus described in U.S. patent application Ser. No. 09/031,632, filed Feb. 27, 1998 and entitled Plug Apparatus Having a Dispersible Plug Member and a Fluid Barrier. The disclosure of that patent application is incorporated herein by this reference.

The plug apparatus 10 includes an outer housing 16 and a plug member 12, which blocks flow through a fluid passage 14 formed generally axially through the plug apparatus. The plug member 12 includes a material 18, and closures 20, 22 above and below the material. The closures 20, 22 prevent contact between the material 18 and fluid 24 in the fluid passage 14.

To permit flow through the fluid passage 14, the material 18 is contacted with a fluid in which at least a part of the material is soluble. The material 18 may be at least partially soluble in the fluid 24 in the fluid passage 14, and/or the material may be soluble in another fluid 26, which may be selectively introduced into contact with the material via another fluid passage 28 formed in the plug apparatus 10. The material 18 is contacted with a fluid in which it is soluble, thereby weakening the material and permitting the material to be dispersed by, for example, creating a pressure differential across the plug member 12, thereby expelling the closures 20, 22 and the at least partially dissolved material 18.

In this embodiment of the present invention, the material 18 is a soluble polymer. Specifically, the material 18 may include a water soluble polymer, such as polyacrylic acid. However, the polymer may be produced from any water soluble monomer which can be polymerized to form a water soluble polymer. For example, the monomer may be acrylic acid, 2-hydroxyethylacrylate, vinyl pyrrolidone, N,N-dimethylacrylamide, etc. Additionally, copolymers, terpolymers, or any combination of water soluble monomers could be used.

Other components may be included in the material 18. For example, the material 18 may include a material which aids in the formation of crack propagation sites, so that the material may be easily broken up for dispersal. An acceptable crack initiation material is sand. Another acceptable crack initiation material is salt, which is also water soluble, and which also aids in the formation of voids in the material if the fluid brought into contact with the material is water.

Figure 2:
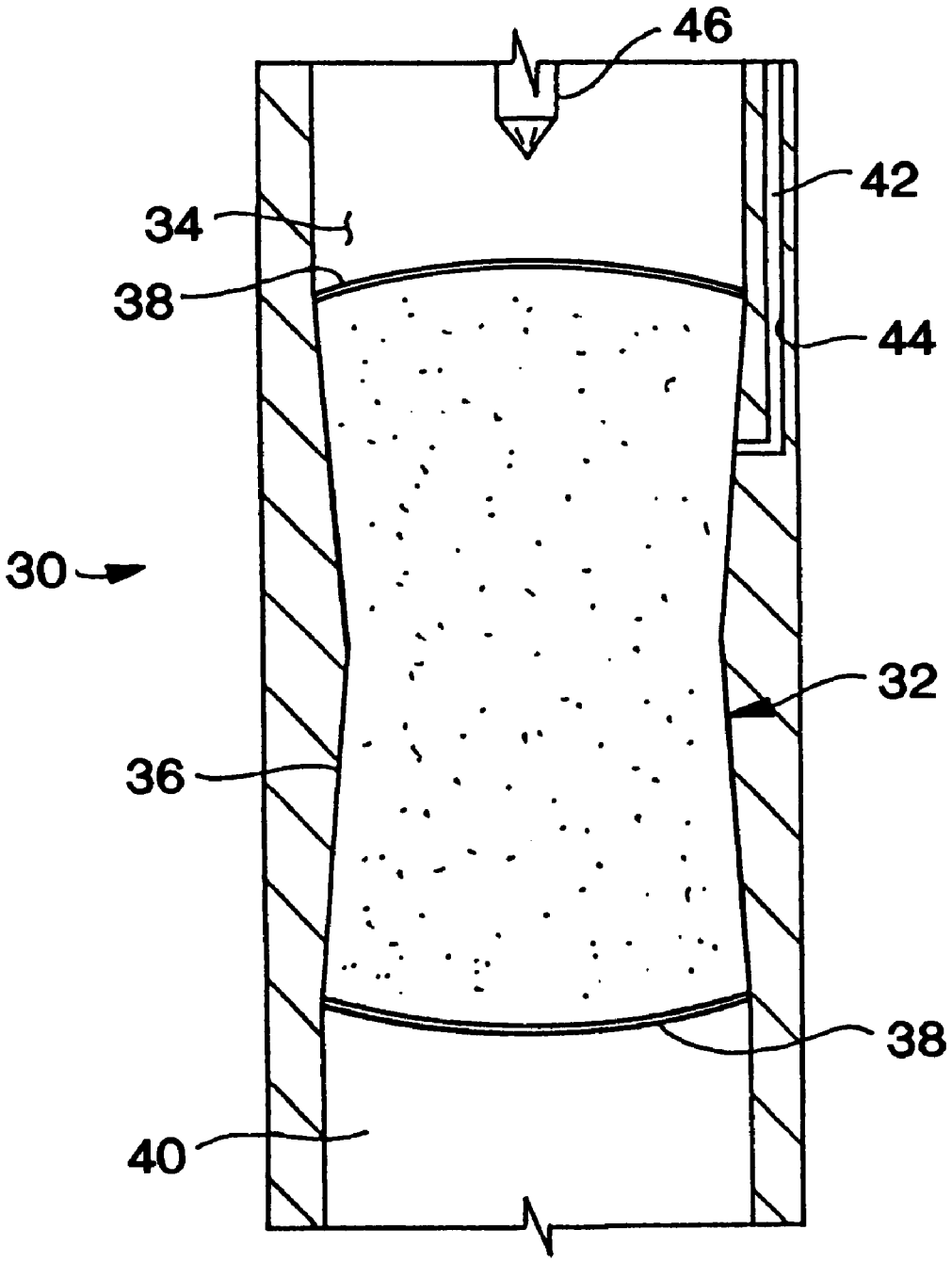
FIG. 2 is a schematic cross-sectional view of a second apparatus embodying principles of the present invention.

Referring additionally now to FIG. 2, another plug apparatus 30 embodying principles of the present invention is representatively and schematically illustrated. The plug apparatus 30 is similar in many respects to the plug apparatus 10 described above, but differs in at least one substantial respect in that a plug member 32 thereof blocking fluid flow through a fluid passage 34 is constructed of a material 36 having a coating 38 applied thereto.

The coating 38 isolates the material 36 from contact with a fluid 40 in the fluid passage 34. However, the material 36 may be at least partially soluble in a fluid 42 selectively introduced into contact with the material via another fluid passage 44 formed in the apparatus 30. The material 36 may be similar to the material 18 described above, or it may be another material, without departing from the principles of the present invention.

The coating 38 is preferably made of a material which is not soluble in the fluid 40. The coating 38 may be a non-water soluble plastic or polymeric material. For example, the coating 38 could be made of polystyrene, polycarbonate, epoxy resin, etc.

Beneficial results may be obtained by making the coating 38 of a relatively brittle material, so that the coating may be selectively fractured to thereby permit contact between the material 36 and the fluid 40. For example, a rod, bar or other structure 46 could be lowered into the fluid passage 34 and impacted with the coating 38 to fracture the coating.

Figure 3:
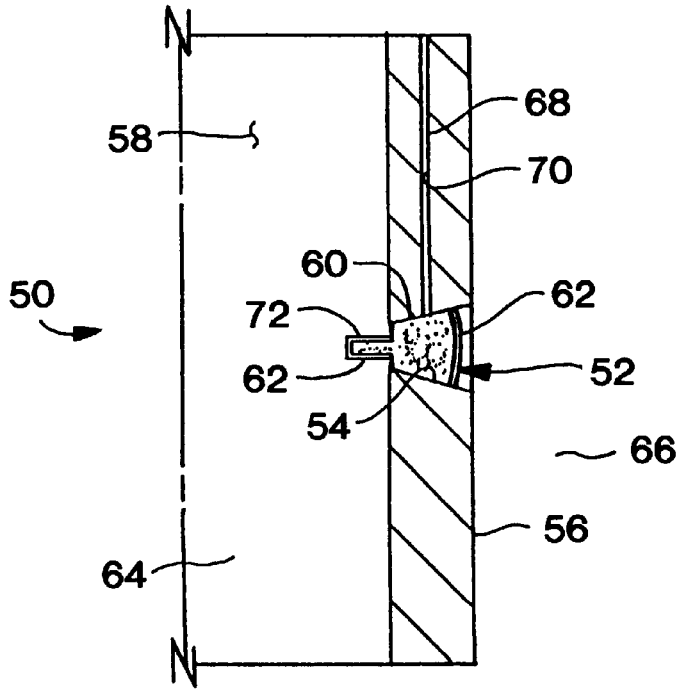
FIG. 3 is a schematic quarter-sectional view of a third apparatus embodying principles of the present invention.

Referring additionally now to FIG. 3, another apparatus 50 embodying principles of the present invention is representatively and schematically illustrated. In the apparatus 50, a plug member 52 initially blocks flow through an opening or fluid passage 54 formed through a sidewall of a tubular housing 56 of the apparatus. The plug member 52 isolates an inner fluid passage 58 from communication with the exterior of the housing 56. As shown in FIG. 3, the plug member 52 and opening 54 are specially constructed to resist a pressure differential directed from the exterior of the housing 56 to the fluid passage 58, but the plug member and opening could also be constructed to alternatively resist an oppositely directed pressure differential, or to resist pressure differentials from both directions.

The plug member 52 includes a material 60, which may be similar to the materials 18, 36 described above. The material 60 may have a coating 62 isolating the material 60 from contact with fluid 64 in the fluid passage 58 and/or from contact with fluid 66 external to the housing 56.

To disperse the plug member 52 and thereby permit flow through the opening 54, a fluid 68 in which at least a portion of the material 60 is soluble may be selectively introduced into contact with the material via a fluid passage 70 formed in the apparatus 50, or the material may be placed into contact with one or both of the fluids 64, 66. For example, a rod, bar or other structure, such as the structure 46 shown in FIG. 2, may be lowered in the fluid passage 58 and impacted with an inwardly extending portion 72 of the plug member 52. Such application of force to the portion 72 by the structure will cause fracture of the coating 62, or complete dislocation of the portion 72 from the remainder of the plug member 52, thereby permitting contact between the fluid 64 and the material 60.

Note that either or both of the plug members 32, 52 described above may be constructed to have a predetermined strength, so that when a predetermined pressure differential is created across the plug member, the material 36, 60 will break, thereby permitting flow through the respective fluid passage 34, 54.

Figure 4:
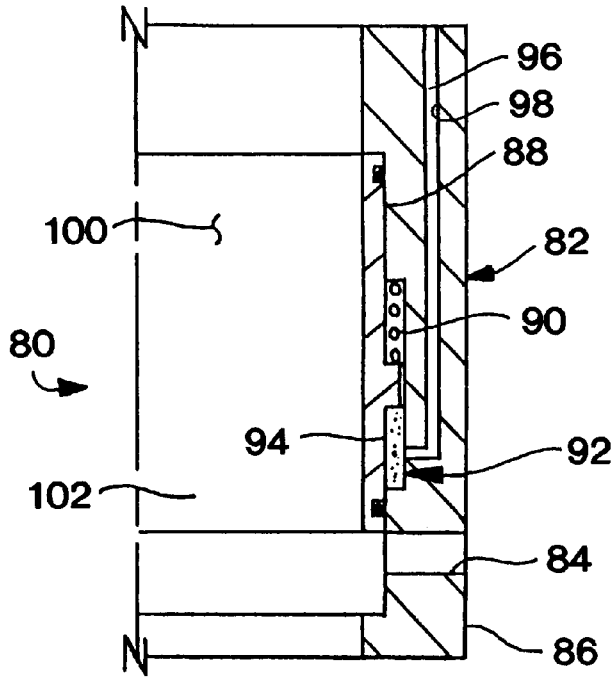
FIG. 4 is a schematic quarter-sectional view of a fourth apparatus embodying principles of the present invention.

Referring additionally now to FIG. 4, another apparatus 80 embodying principles of the present invention is representatively and schematically illustrated. The apparatus 80 is depicted as including a valve 82 for selectively permitting and preventing flow through an opening or fluid passage 84 formed through a housing 86 of the valve. However, it is to be clearly understood that the apparatus 80 is merely representative of a wide variety of types of apparatus which may embody principles of the present invention. For example, an apparatus constructed in accordance with the principles of the present invention does not necessarily include a valve or other flow control device.

The valve 82 includes a displacement member or sleeve 88, which displaces relative to the housing 86 in operation of the apparatus 80. Specifically, the sleeve 88 is a closure member which permits flow through the opening 84 when the sleeve is positioned as shown in FIG. 4, but which prevents flow through the opening when it is downwardly displaced relative to the housing 86. A spring or other bias member 90 biases the sleeve 88 downward, but the sleeve is prevented from displacing downwardly by a blocking member 92.

The blocking member 92 includes a material 94 which may be similar to any of the materials 18, 36, 60 described above. The blocking member 92 may be dispersed, to thereby permit the bias member 90 to downwardly displace the sleeve 88 relative to the housing 86, by selectively introducing a fluid 96 into contact with the material via a fluid passage 98 formed in the apparatus 80. Alternatively, a portion (similar to portion 72 shown in FIG. 3) of the blocking member 92 could extend inwardly into an inner fluid passage 100 formed through the apparatus 80, so that a structure (similar to structure 46 shown in FIG. 2) could impact the blocking member and thereby provide contact between the material 94 and a fluid 102 in the fluid passage 100. When the fluid 96 and/or fluid 102 contacts the material 94, the material at least partially dissolves in the fluid, thereby permitting the blocking member 92 to be dispersed sufficiently for the bias member 90 to displace the sleeve 88 downwardly, so that flow is prevented through the opening 84.

Note that the blocking member 92 may be constructed with a predetermined strength, so that when a predetermined force is applied to the blocking member, for example, by the bias member 90, the material 94 will break, thereby permitting displacement of the displacement member 88 in operation of the apparatus 80.

As described above, the materials 18, 36, 60 and 94 may include a polymer material soluble in a fluid. The material may be a mixture of a water soluble polymer, such as polyacrylic acid, along with salt and/or sand.

For example, the applicants have found that an acceptable material results from a mixture of 100 g acrylic acid, 700 g salt of 14/20 grain size, along with 0.1 g of a polymerization initiator dissolved in 5 ml water, or a proportionate multiplication of these constituents. The initiator may, for example, be 2,2'-Azobis (N,N'-dimethyleneisobutyramidine) dihydrochloride marketed by Wako under the trade name VA-044. Other acceptable material may result from the following examples of mixtures:

a) 45 g acrylic acid, 200 g sand of 20/40 grain size, along with 0.15 g polymerization initiator dissolved in 5 ml water;

b) 100 g acrylic acid, 700 g sand of 20/40 grain size, along with 0.3 g polymerization initiator dissolved in 3 ml water;

c) 100 g acrylic acid, 700 g salt of 14/20 grain size, along with 0.3 g polymerization initiator dissolved in 5 ml water;

d) 100 g acrylic acid, 700 g salt of 14/20 grain size, along with 0.6 g polymerization initiator dissolved in 5 ml water;

e) 100 g acrylic acid, 350 g sand of 20/40 grain size, 350 g salt of 14/20 grain size, along with 0.3 g polymerization initiator dissolved in 5 ml water;

f) 100 g acrylic acid, 700 g salt of 14/20 grain size, along with 0.3 g polymerization initiator dissolved in 3 ml water;

g) 100 g acrylic acid, 700 g salt of 20/40 grain size, along with 0.3 g polymerization initiator dissolved in 3 ml water; and h) 100 g acrylic acid, 350 g sand of 20/40 grain size, 350 g salt of 20/40 grain size, along with 0.3 g polymerization initiator dissolved in 3 ml water.

To prepare the material, the monomer is placed in a suitable container or mold and mixed with crack initiator material and/or other soluble material, such as sand and/or salt, if any. Nitrogen is bubbled through the mixture to remove Oxygen from the monomer solution. The initiator dissolved in water is then added to the mixture. The mixture is then heated to the appropriate polymerization temperature.

Of course, a person skilled in the art would find it obvious to make modifications, substitutions, deletions, additions and other changes to the embodiments described herein, and these changes are contemplated by the principles of the present invention. Accordingly, the foregoing detailed description is to be clearly understood as being given by way of illustration and example only, the spirit and scope of the present invention being limited solely by the appended claims.

What is claimed is:

1. A plug apparatus for use in conjunction with operations performed in a subterranean well, comprising:

a plug member including a polymer soluble in a fluid and a coating of a material insoluble in the fluid, the coating isolating the polymer from contact with the fluid.

2. The plug apparatus according to claim 1, wherein the polymer is soluble in the fluid present in a first fluid passage blocked by the plug member.

3. The plug apparatus according to claim 1, wherein the polymer is soluble in the fluid present in a first fluid passage, the plug member blocking fluid flow through a second fluid passage.

4. The plug apparatus according to claim 1, wherein the polymer is a water soluble polymer.

5. The plug apparatus according to claim 1, wherein the polymer is a polyacrylic acid.

6. The plug apparatus according to claim 1, wherein the plug member is constructed of a mixture of the polymer and a second material soluble in the fluid.

7. The plug apparatus according to claim 6, wherein the second soluble material is salt.

8. The plug apparatus according to claim 1, wherein the plug member is constructed of a mixture of the polymer and a crack initiation material.

9. The plug apparatus according to claim 8, wherein the crack initiation material is a granular material.

10. The plug apparatus according to claim 8, wherein the crack initiation material is sand.

11. The plug apparatus according to claim 8, wherein the crack initiation material is salt.

12. The plug apparatus according to claim 1, wherein the coating material is water-insoluble.

13. The plug apparatus according to claim 1, wherein the coating material fractures and permits contact between the fluid and the polymer in response to a force applied to the plug member.

14. The plug apparatus according to claim 1, wherein the coating material is a selected one of a plastic and a polymeric material.

15. The plug apparatus according to claim 1, wherein the coating material is a selected one of a polystyrene, polycarbonate and epoxy material.

16. The plug apparatus according to claim 1, wherein the polymer is a polymerized vinyl monomer.

17. The plug apparatus according to claim 16, wherein the polymer is one or more of acrylic acid, 2-hydroxyethylacrylate, vinyl pyrrolidone, and N,N-dimethylacrylamide.

18. The plug apparatus according to claim 16, wherein the polymer is one or more of a copolymer and a terpolymer.

19. The plug apparatus according to claim 1, wherein the plug member blocks flow of the fluid through a fluid passage extending through the plug apparatus.

20. The plug apparatus according to claim 1, wherein the plug member blocks fluid flow through a sidewall of the apparatus.

21. An apparatus for use in operations performed in conjunction with a subterranean well, the apparatus comprising:

a displacement member, the displacement member displacing in operation of the apparatus; and a blocking member preventing displacement of the displacement member, the blocking member being a polymer soluble in a fluid present proximate the apparatus, the blocking member including a coating of a material insoluble in the fluid, the coating material isolating the polymer from contact with the fluid.

22. The apparatus according to claim 21, wherein the displacement member is positionable in a selected one of first and second positions, and wherein the blocking member prevents displacement of the displacement member between the first and second positions.

23. The apparatus according to claim 21, wherein the displacement member is a closure operative to selectively permit and prevent flow through a fluid passage.

24. The apparatus according to claim 23, wherein the closure selectively permits and prevents flow of the fluid.

25. The apparatus according to claim 23, wherein the fluid passage is formed through the apparatus.

26. The apparatus according to claim 23, wherein the fluid passage is formed through a sidewall of the apparatus.

27. The apparatus according to claim 21, wherein the polymer is soluble in the fluid present in a first fluid passage formed in the apparatus.

28. The apparatus according to claim 21, wherein the polymer is soluble in the fluid present in a first fluid passage, the displacement member blocking fluid flow through a second fluid passage.

29. The apparatus according to claim 21, wherein the polymer is a water soluble polymer.

30. The apparatus according to claim 21, wherein the polymer is a polyacrylic acid.

31. The apparatus according to claim 21, wherein the blocking member is constructed of a mixture of the polymer and a second material soluble in the fluid.

32. The apparatus according to claim 31, wherein the second soluble material is salt.

33. The apparatus according to claim 21, wherein the blocking member is constructed of a mixture of the polymer and a crack initiation material.

34. The apparatus according to claim 33, wherein the crack initiation material is a granular material.

35. The apparatus according to claim 33, wherein the crack initiation material is sand.

36. The apparatus according to claim 33, wherein the crack initiation material is salt.

37. The apparatus according to claim 21, wherein the coating material is water-insoluble.

38. The apparatus according to claim 21, wherein the coating material fractures and permits contact between the fluid and the polymer in response to a force applied to the blocking member.

39. The apparatus according to claim 21, wherein the coating material is a selected one of a plastic and a polymeric material.

40. The apparatus according to claim 21, wherein the coating material is a selected one of a polystyrene, polycarbonate and epoxy material.

41. The apparatus according to claim 21, wherein the polymer is a polymerized vinyl monomer.

42. The apparatus according to claim 41, wherein the polymer is one or more of acrylic acid, 2-hydroxyethylacrylate, vinyl pyrrolidone, and N,N-dimethylacrylamide.

43. The apparatus according to claim 41, wherein the polymer is one or more of a copolymer and a terpolymer.

44. An apparatus for use in operations performed in conjunction with a subterranean well, the apparatus comprising:

a displacement member, the displacement member displacing in operation of the apparatus;

a blocking member preventing displacement of the displacement member, the blocking member being a polymer soluble in a fluid present proximate the apparatus; and a valve selectively permitting and preventing flow through a fluid passage in response to displacement of the displacement member.

45. The apparatus according to claim 44, wherein the valve selectively permits and prevents flow of the fluid.

46. The apparatus according to claim 44, wherein the fluid passage is formed through the apparatus.

47. The apparatus according to claim 44, wherein the fluid passage is formed through a sidewall of the apparatus.

* * * * *